US009084462B2

(12) United States Patent
Michael

(10) Patent No.: US 9,084,462 B2
(45) Date of Patent: Jul. 21, 2015

(54) GIFT PRESENTATION BOX

(71) Applicant: Amaranti, LLC, Vancouver, WA (US)

(72) Inventor: Jeffrey Michael, Vancouver, WA (US)

(73) Assignee: Amaranti, LLC, Vancouver, WA (US)

( * ) Notice: Subject to any disclaimer, the term of this patent is extended or adjusted under 35 U.S.C. 154(b) by 354 days.

(21) Appl. No.: 13/721,411

(22) Filed: Dec. 20, 2012

(65) Prior Publication Data

US 2014/0175091 A1 Jun. 26, 2014

(51) Int. Cl.
*A45C 11/04* (2006.01)
*A45C 11/16* (2006.01)

(52) U.S. Cl.
CPC ..... *A45C 11/16* (2013.01)

(58) Field of Classification Search
CPC ..... A45C 11/16; A47F 7/02; A47F 7/03
USPC ..... 206/6.1, 45.28, 372, 373, 566, 751, 206/754–756, 759, 761, 762, 764–768; 16/369, 370; 248/127, 128, 157, 161, 248/371; 362/155
See application file for complete search history.

(56) References Cited

U.S. PATENT DOCUMENTS

| | | | | | |
|---|---|---|---|---|---|
| 1,007,113 | A | | 10/1911 | Kazian | |
| 1,240,671 | A | | 9/1917 | Catala | |
| 1,893,526 | A | * | 1/1933 | Shriver | 312/266 |
| 2,488,067 | A | * | 11/1949 | Roark | 312/200 |
| 2,755,921 | A | * | 7/1956 | Ortendahl | 206/6.1 |
| 2,991,876 | A | | 7/1961 | Shiffman | |
| 3,612,635 | A | * | 10/1971 | Uyeda et al. | 206/315.11 |
| 3,937,319 | A | | 2/1976 | Roy | |
| 3,937,320 | A | | 2/1976 | Chao et al. | |
| 4,461,383 | A | * | 7/1984 | Groff | 206/6.1 |
| 4,732,269 | A | | 3/1988 | Roy | |
| 5,692,605 | A | * | 12/1997 | Lai | 206/6.1 |
| 6,844,686 | B1 | | 1/2005 | Schneck et al. | |
| 7,077,267 | B2 | * | 7/2006 | Lee | 206/373 |
| 2010/0116710 | A1 | * | 5/2010 | Huang et al. | 206/762 |

* cited by examiner

*Primary Examiner* — Luan K Bui
(74) *Attorney, Agent, or Firm* — Jay R Beyer

(57) ABSTRACT

A gift presentation box includes an upper portion hinged to a lower portion and a movable article mount for supporting an article to be presented in the gift presentation box. An articulated linkage includes a plurality of links connecting the article mount to other elements of the presentation box such that the articulated linkage moves the article mount from a stored position to a presentation position that is elevated relative to the stored portion when the upper portion of the box is moved from a closed position to an open position.

17 Claims, 11 Drawing Sheets

GIFT PRESENTATION BOX

BACKGROUND

The present invention relates to a gift presentation box for storing and presenting an article such as a finger ring or other type of jewelry or gift item.

Jewelry and other gift items are commonly sold and given as gifts in accompanying gift boxes that are intended to store and display the jewelry or gift item in an attractive manner. Conventional gift boxes are commonly of a clamshell design with an upper case portion and a lower case portion that are connected by a hinge. A biasing arrangement typically holds the upper case portion and the lower case portion biased shut when the gift box is in a closed position and also biases the gift box into an open position when the upper case portion is moved to the open position. The jewelry or gift item is typically supported and retained for display purposes on a decorative insert member that is nested in the lower case portion.

The present invention provides a novel presentation box for storing and presenting an article such as a finger ring or other type of jewelry or gift item. As will be described in more detail hereinafter, the presentation box of the present invention includes a unique arrangement for moving the article from a stored position within the presentation box when the presentation box is in a closed position to an elevated presentation position when the presentation box is in an open position.

SUMMARY

In some aspects, the present disclosure provides a presentation box for storing and presenting an article. The presentation box may include an upper case forming a top portion of the presentation box and a lower case forming a bottom portion of the presentation box. A hinge arrangement may connect the upper case to the lower case such that the upper case may be pivoted relative to the lower case between a closed position in which the upper case and the lower case define an enclosed volume for storing the article within the presentation box and an open position for presenting the article. The presentation box includes an articulated linkage and a movable article mount for supporting the article to be presented in the presentation box. The articulated linkage has a plurality of links connecting the article mount to other elements of the presentation box. The articulated linkage is configured to move the article mount from a stored position when the upper case is in the closed position to a presentation position that is elevated relative to the stored position when the upper case is in the open position thereby presenting the article when the upper case is moved from the closed position to the open position.

In some aspects, the article mount and the articulated linkage maintain the article in a generally upright orientation throughout the range of motion of the article mount from the stored position to the presentation position.

In some aspects, the articulated linkage includes a dampening arrangement that controls the speed at which the article mount moves from the stored position to the presentation position thereby allowing the movement of the article mount from the stored position to the presentation position to take longer than the time in which the upper case is moved from the closed position to the open position.

In some aspects, the articulated linkage includes a delaying arrangement that delays the time at which the article mount begins to move from the stored position to the presentation position relative to the upper case being moved from the closed position to the open position.

In some aspects, the presentation box includes a light source and the hinge arrangement includes an oversized hinge that houses a battery. The hinge arrangement also includes a switch for activating the light source when the upper case is in the open position.

In some aspects, the parting line between the upper case and the lower case is a curved parting line when viewed in the direction along the rotational axis of the hinge arrangement.

In some aspects, the articulated linkage is a separate self-contained sub-assembly that may be attached to other elements of the presentation box.

In some aspects, the articulated linkage includes a retaining piece for retaining the linkage within the presentation box. The retaining piece allows at least portions of the articulated linkage to be disconnected from the other elements of the presentation box.

In some aspects, the presentation box is a jewelry ring box.

In some aspects, the article mount is a cylindrical element with an elongated ring slot.

In some aspects, the articulated linkage includes a four-bar linkage and a drive link with portions of the lower case acting as a fixed bar of the four-bar linkage. The fixed bar has a first and a second spaced apart pivot point. The movable article mount acts as a movable second bar of the four-bar linkage with the movable second bar having a first and a second spaced apart pivot point. The four-bar linkage further includes a movable third bar and a movable fourth bar with both the third bar and the fourth bar having a first and a second spaced apart pivot point. The movable third bar is pivotally connected between the fixed bar and the movable second bar with the first pivot point of the third bar pivotally connected to the first pivot point of the fixed bar and the second pivot point of the third bar pivotally connected to the first pivot point of the movable second bar. The movable fourth bar is pivotally connected between the fixed bar and the movable second bar with the first pivot point of the fourth bar pivotally connected to the second pivot point of the fixed bar and the second pivot point of the fourth bar pivotally connected to the second pivot point of the movable second bar. The drive link has a first and a second spaced apart pivot point with the first pivot point being pivotally connected to one of the movable bars and the second pivot point being pivotally connected to other elements of the presentation box such that the drive link causes the four-bar linkage to elevate the movable article mount relative to the lower case and present the article when the upper case is moved from the closed position to the open position.

In some aspects, the movable third bar is a wide link with the first and second pivot points each including two spaced apart pivot points to stabilize the articulated linkage and article mount as the article mount moves from the stored position to the presentation position.

In some aspects, the drive link is a pull link that is concealed in the hinge arrangement and the four-bar linkage.

In some aspects, the elements of the articulated linkage align such that they appear to be one decorative shape when the article mount is in the presentation position.

In some aspects, the articulated linkage includes a securing arrangement that is driven by the movement of the articulated linkage such that the securing arrangement secures the article in place on the article mount when the upper case is in the closed position and releases the article so that the article may be removed from the article mount when the upper case is in the open position.

In some aspects, the articulated linkage includes a movable cover that moves with the articulated linkage to conceal elements of the articulated linkage as the article mount moves from the stored position to the presentation position.

In some aspects, the presentation box includes a biasing arrangement for biasing the upper case to the open position and the closed position.

In some aspects, the present disclosure provides an articulated linkage for use in a presentation box for storing and presenting an article. The presentation box may include an upper case forming a top portion of the presentation box and a lower case forming a bottom portion of the presentation box. The presentation box may further include a hinge arrangement for connecting the upper case to the lower case such that the upper case may be pivoted relative to the lower case between a closed position in which the upper case and the lower case define an enclosed volume for storing the article within the presentation box and an open position for presenting the article. The articulated linkage includes a movable article mount for supporting the article to be presented in the presentation box. The articulated linkage also includes a plurality of links for connecting the article mount to elements of the presentation box when the articulated linkage is installed in the presentation box. The articulated linkage is configured to move the article mount from a stored position to a presentation position that is elevated relative to the stored position when the articulated linkage is installed in the presentation box and when the upper case is moved from the closed position to the open position.

In some aspects, the articulated linkage includes a retaining piece for retaining the linkage within the presentation box. The retaining piece allows at least portions of the articulated linkage to be disconnected from the presentation box.

In some aspects, the articulated linkage includes at least portions of a four-bar linkage and a drive link. The four-bar linkage includes a fixed bar that may be provided by the lower case of the presentation box. The fixed bar has a first and a second spaced apart pivot point. The movable article mount acts as a movable second bar of the four-bar linkage with the movable second bar having a first and a second spaced apart pivot point. The four-bar linkage further includes a movable third bar and a movable fourth bar with both the third bar and the fourth bar having a first and a second spaced apart pivot point. The movable third bar is pivotally connected between the fixed bar and the movable second bar with the first pivot point of the third bar pivotally connected to the first pivot point of the fixed bar and the second pivot point of the third bar pivotally connected to the first pivot point of the movable second bar. The movable fourth bar is pivotally connected between the fixed bar and the movable second bar with the first pivot point of the fourth bar pivotally connected to the second pivot point of the fixed bar and the second pivot point of the fourth bar pivotally connected to the second pivot point of the movable second bar. The drive link has a first and a second spaced apart pivot point with the first pivot point of the drive link being pivotally connected to one of the movable bars. The second pivot point of the drive link is pivotally connected to other elements of the presentation box when the articulated linkage is installed in the presentation box such that the drive link causes the four-bar linkage to move the article mount from the stored position to the presentation position and present the article when the upper case is moved from the closed position to the open position.

In some aspects, the fixed bar of the four-bar linkage is provided as part of the lower case of the presentation box.

In some aspects, the movable third bar is a wide link with the first and second pivot points each including two spaced apart pivot points to stabilize the articulated linkage and article mount as the article mount moves from the stored position to the presentation position.

In some aspects, the elements of the articulated linkage align such that they appear to be one decorative shape when the article mount is in the presentation position.

In some aspects, the articulated linkage includes a securing arrangement that is driven by the movement of the articulated linkage such that the securing arrangement secures the article in place on the article mount when the article mount is in the stored position and releases the article so that the article may be removed from the article mount when the article mount is in the presentation position.

In some aspects, the articulated linkage includes a movable cover that moves with the articulated linkage to conceal the elements of the articulated linkage as the article mount moves from the stored position to the presentation position.

DESCRIPTION OF DRAWINGS

Like reference numerals in the various drawings indicate like elements.

DETAILED DESCRIPTION

Figure 1A:
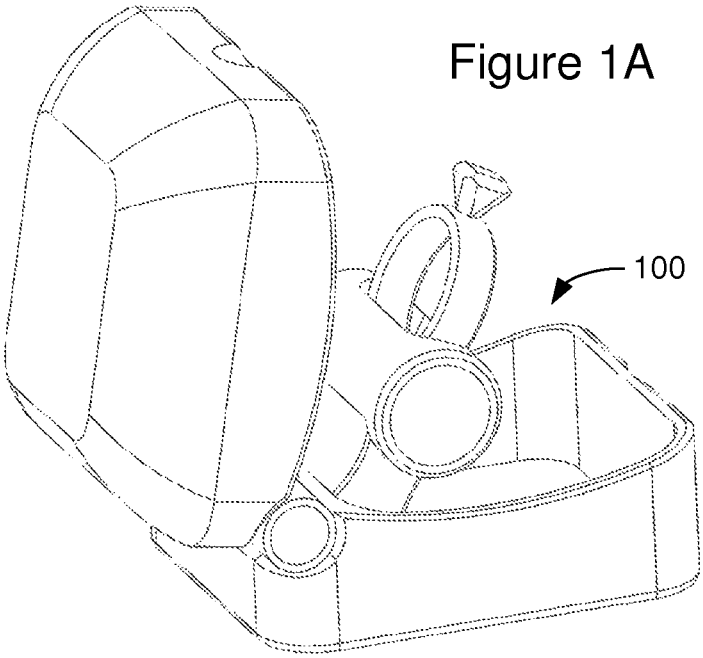
FIG. 1A is a perspective illustration of a gift presentation box in accordance with aspects of the present invention with the presentation box in the open position.
Figure 1F:
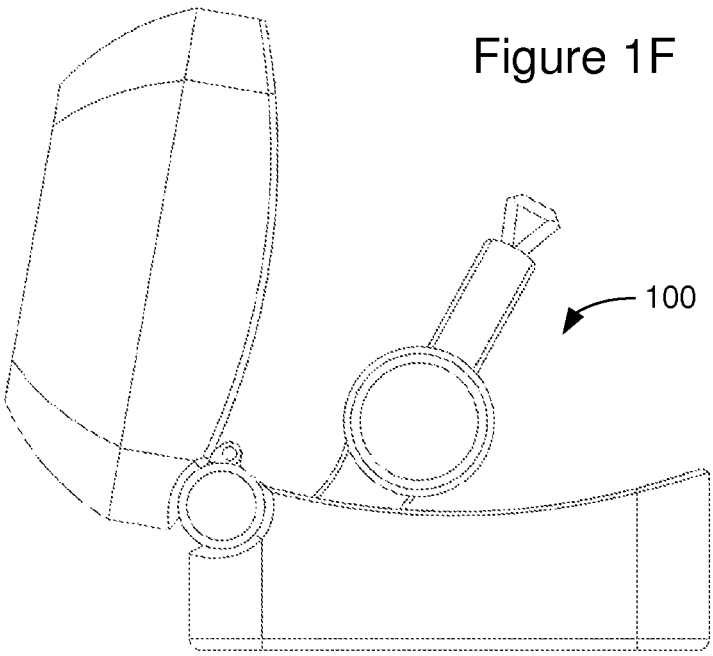
FIG. 1F is a side view of the gift presentation box of FIG. 1A in the open position.
Figure 1D:
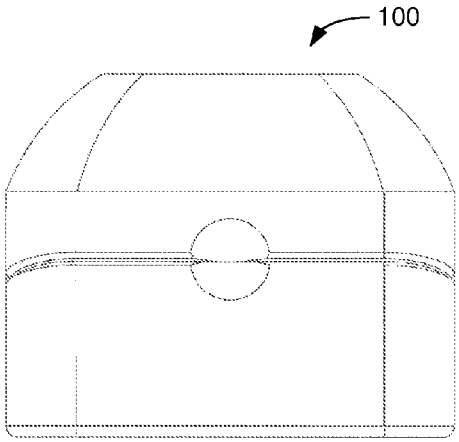
FIG. 1D is a front view of the gift presentation box of FIG. 1A in the closed position.

Referring now to FIGS. 1A-1F and 2A-2D, a gift presentation box 100 in accordance with aspects of the invention will be described. FIGS. 1A and 1F show perspective and side views respectively of presentation box 100 in an open position. FIGS. 1B-1E show side, top, front, and back views respectively of presentation box 100 in a closed position. FIGS. 2A-2D are side views of presentation box 100 showing the internal elements of the presentation box as it is progressively moved from the closed position to the open position. In the specific embodiment illustrated in FIGS. 1A-1F and 2A-2D, presentation box 100 is a finger ring gift presentation box. However, it should be understood that a presentation box in accordance with the invention is not limited to a finger ring gift presentation box, but instead may be any type of gift presentation box such as a presentation box for some other type of jewelry, or a presentation box for storing and presenting any other ornamental article.

Figure 1B:
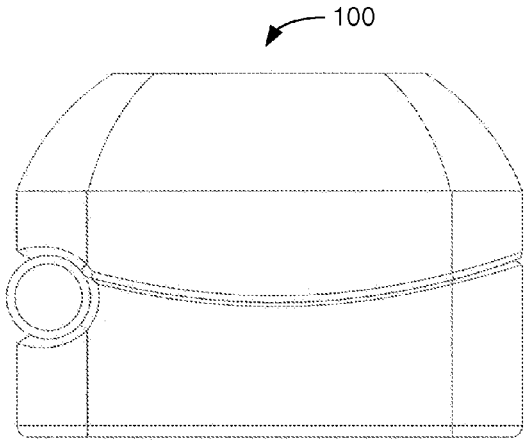
FIG. 1B is a side view of the gift presentation box of FIG. 1A in the closed position.
Figure 1C:
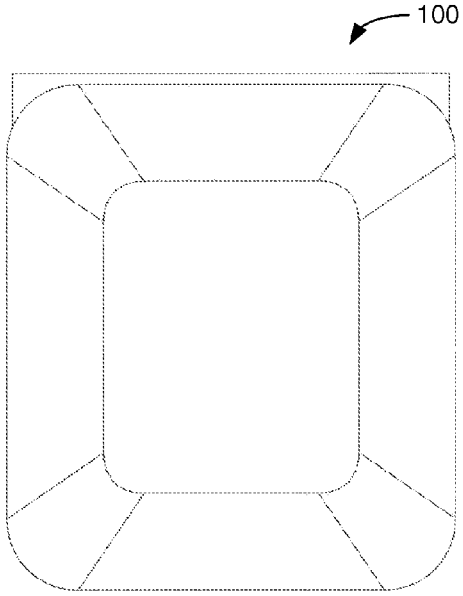
FIG. 1C is a top view of the gift presentation box of FIG. 1A in the closed position.
Figure 1E:
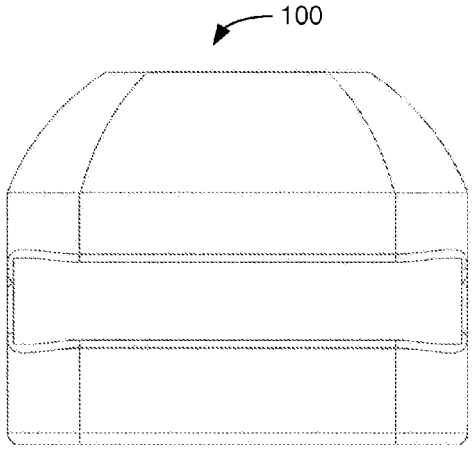
FIG. 1E is a back view of the gift presentation box of FIG. 1A in the closed position.

Presentation box 100 may include an upper case 102 forming a top portion of the presentation box and a lower case 104 forming a bottom portion of the presentation box. A hinge arrangement 106 may connect upper case 102 to lower case 104 such that upper case 102 may be pivoted relative to lower case 104 between a closed position as illustrated in FIG. 1B and an open position as illustrated in FIG. 1F. In the closed position, upper case 102 and lower case 104 define an enclosed volume for storing the article within presentation box 100. As will be described in more detail hereinafter, and as illustrated best in FIGS. 2A-2D, presentation box 100 also includes a presentation arrangement 108 for presenting the article when presentation box 100 is opened as illustrated in FIG. 1F.

Figure 2A:
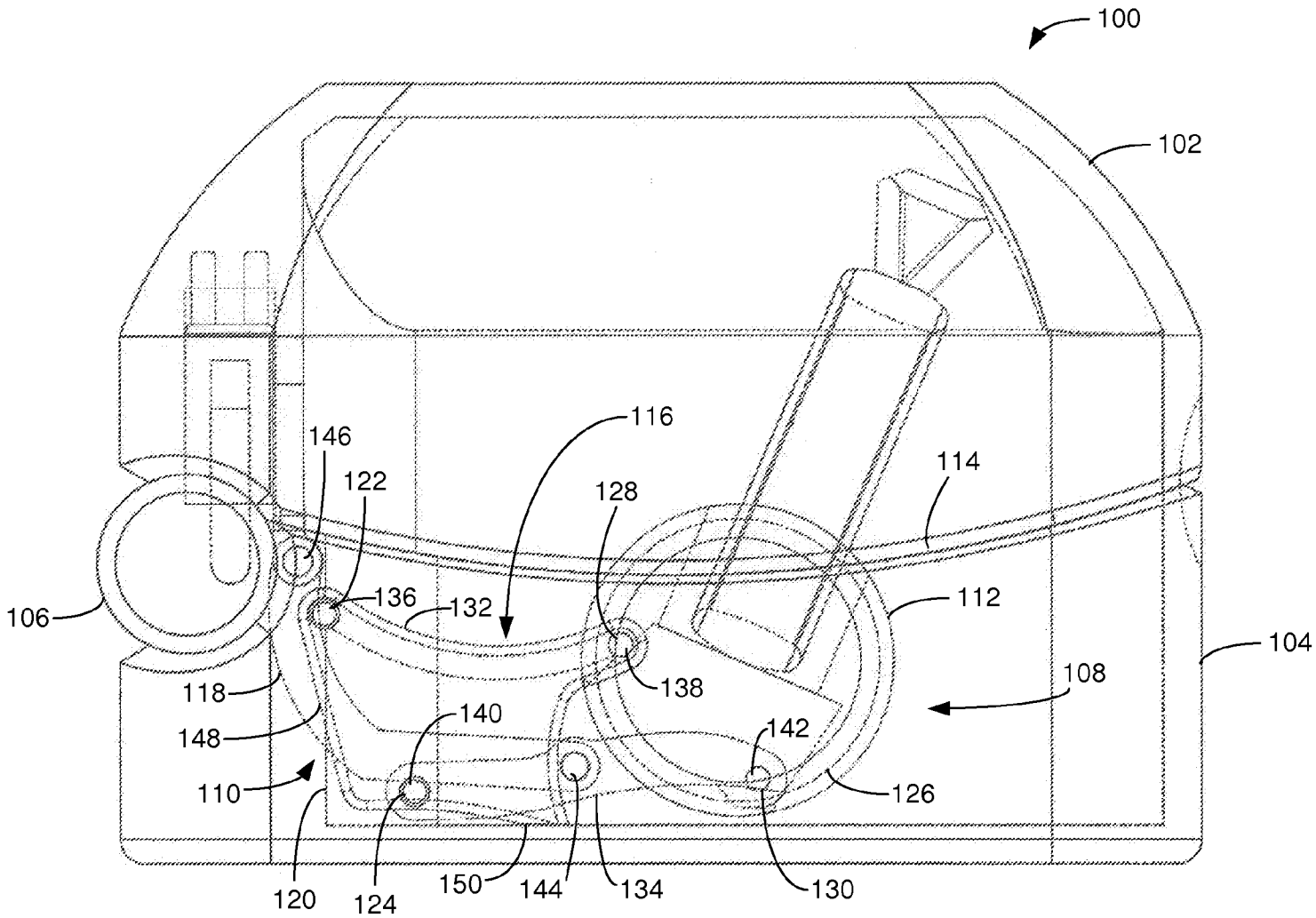
FIG. 2A is a side view of the gift presentation box of FIG. 1A in the closed position showing the internal elements of the presentation box.
Figure 2B:
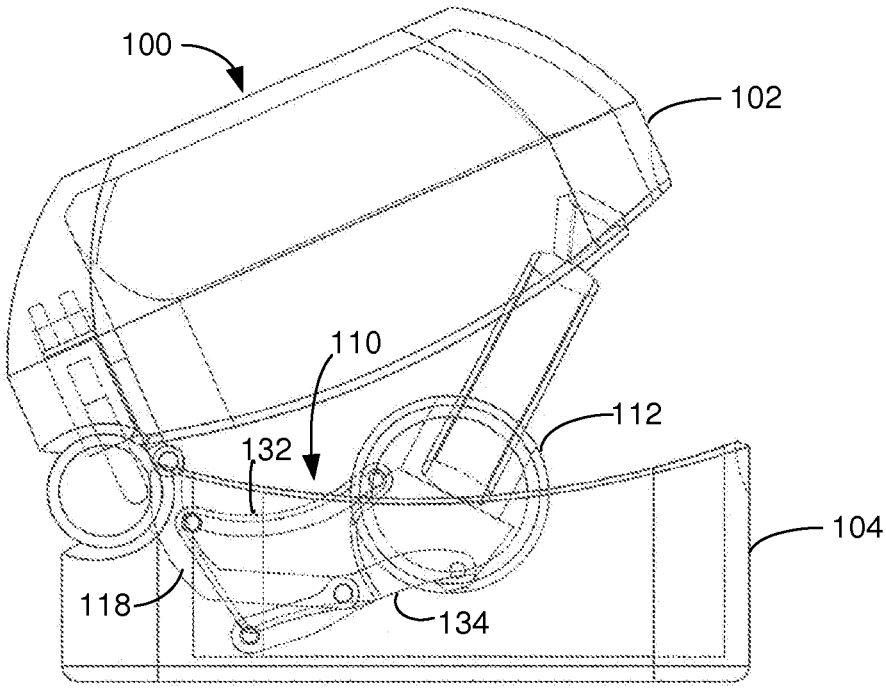
FIGS. 2B and 2C are side views of the gift presentation box of FIG. 1A in progressive stages of being moved from the closed position to the open position showing the internal elements of the presentation box.
Figure 2C:
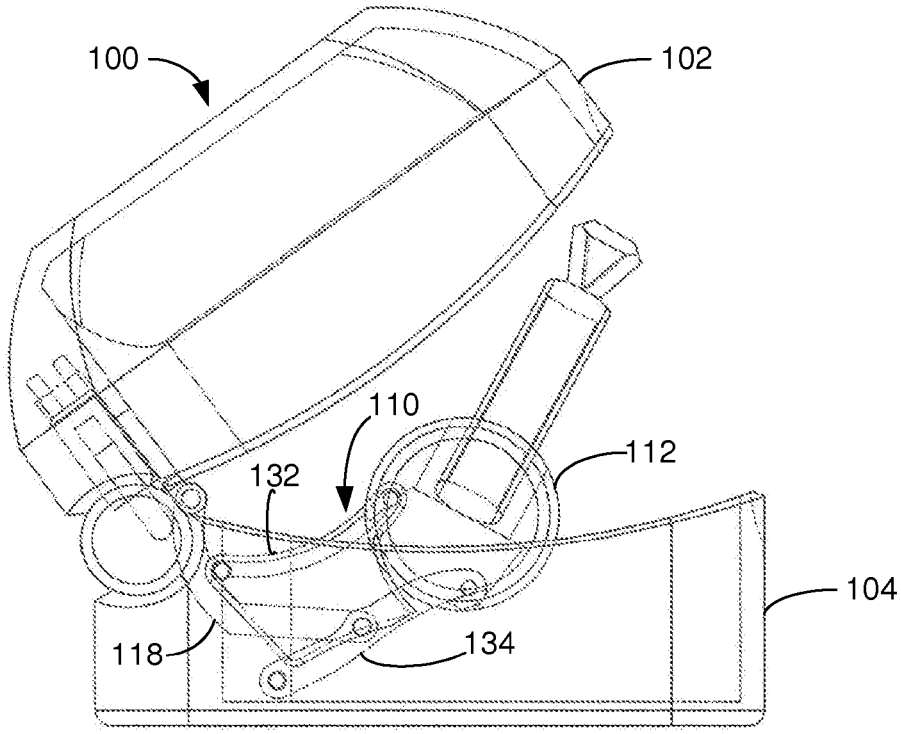
Figure 2D:
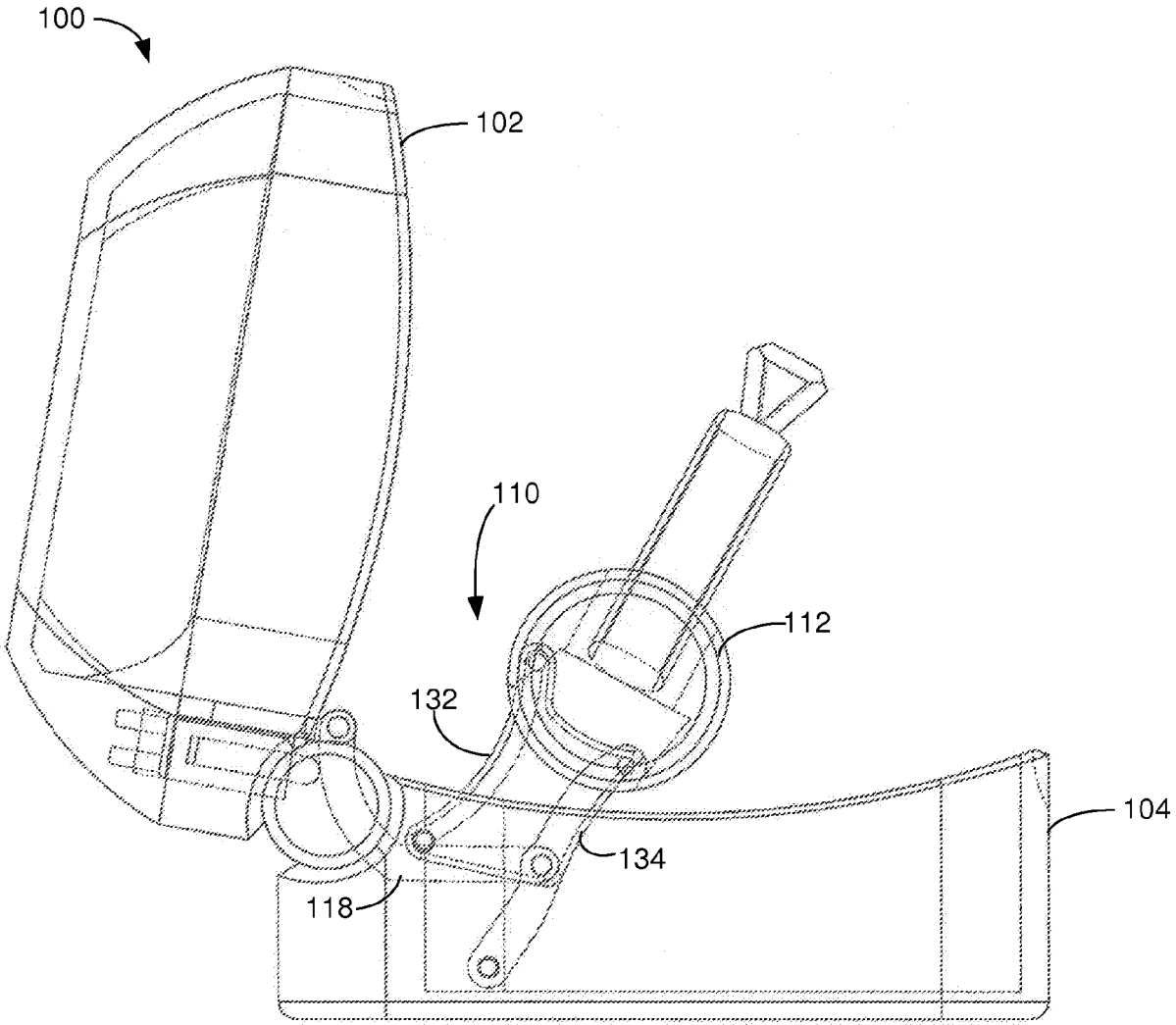
FIG. 2D is a side view of the gift presentation box of FIG. 1A in the open position showing the internal elements of the presentation box.

In accordance with some aspects of the invention, presentation box 100 includes an articulated linkage 110 and a movable article mount 112 for supporting the article to be presented in the presentation box. As illustrated best in FIGS. 2A-2D, articulated linkage 110 has a plurality of links connecting article mount 112 to other elements of the presentation box. As will be described in more detail hereinafter, articulated linkage 110 may be configured to hold article mount 112 in a stored position when upper case 102 is in the closed position as illustrated in FIG. 2A. Articulated linkage 110 may also be configured to hold article mount 112 in a presentation position that is elevated relative to the stored position when the upper case is in the open position as illustrated in FIG. 2D. Furthermore, articulated linkage 110 may be configured to move article mount 112 from the stored position to the presentation position when upper case 102 is moved from the closed position to the open position. This configuration allows a presentation box in accordance with aspects of the invention to uniquely present the article to a recipient when the recipient opens the presentation box.

In the embodiment shown in FIGS. 2A-2D, article mount 112 is a cylindrical element with an elongated ring slot for supporting a finger ring that runs along the axis of the cylinder. The ring slot may be configured to accommodate and hold a ring in a visually appealing manner. Although article mount 112 is described as being cylindrical in shape and including a finger ring slot, it should be understood that these are not requirements of the invention. Instead, article mount 112 may take any desired shape and be configured to support any desired article. For example, the article mount may take the form of a platform that may be used to mount a pair of earrings.

As illustrated in FIGS. 2A-2D, article mount 112 and articulated linkage 110 may maintain the article in a generally upright orientation throughout the range of motion of the article mount from the stored position to the presentation position. However, it should be understood that the specific orientation of the article mount may be any orientation that provides desired storage and presentation orientations for the article. In the particular embodiment shown, the finger ring is held at a slight angle toward the front of the box throughout the motion of the article mount. This allows the ring to be viewed from the top by the recipient as the presentation box is opened and the ring is being presented by the presentation box.

In the embodiment of FIGS. 2A-2D, the parting line between upper case 102 and lower case 104 is a curved parting line 114 when viewed in the direction along the rotational axis of hinge arrangement 106. Although parting line 114 is shown as a curved parting line, this is not a requirement. Instead, the parting line may take any desired shape such as, but not limited to, a straight parting line or an angled parting line. However, curved parting line 114 may be used to provide a more unique look for presentation box 100. Furthermore, curved parting line 114 may be used to allow the recipient to see into presentation box 100 earlier than may be possible compared to a box with a more conventional straight parting line thereby allowing the recipient to view more of the movement of the article being presented when the presentation box is opened.

As is the case for conventional gift boxes, the presentation box of the invention may include a biasing arrangement for biasing the upper case to the open position and also biasing the upper case to the closed position. This biasing arrangement may be provided by a spring clip or any other desired biasing arrangement.

In the embodiment shown in FIGS. 2A-2D, articulated linkage 110 includes a four-bar linkage 116 and a drive link 118. Portions of lower case 104 act as a fixed bar 120 of four-bar linkage 116 and fixed bar 120 has a first pivot point 122 and a second pivot point 124 that are spaced apart from one another. Portions of movable article mount 112 act as a movable second bar 126 of four-bar linkage 116 with movable second bar 126 having a first pivot point 128 and a second pivot point 130 that are spaced apart from one another. Four-bar linkage 116 further includes a movable third bar 132 and a movable fourth bar 134. Third bar 132 includes a first pivot point 136 and a second pivot point 138 that are spaced apart from one another and fourth bar 134 includes a first pivot point 140 and a second pivot point 142 that are spaced apart from one another.

In this embodiment, movable third bar 132 is pivotally connected between fixed bar 120 (which is provided as portions of lower case 104) and movable second bar 126 (which is provided as portions of movable article mount 112). First pivot point 136 of third bar 132 is pivotally connected to first pivot point 122 of fixed bar 120 and second pivot point 138 of third bar 132 is pivotally connected to first pivot point 128 of movable second bar 126. Movable fourth bar 134 is also pivotally connected between fixed bar 120 and movable second bar 126 with first pivot point 140 of fourth bar 134 pivotally connected to second pivot point 124 of fixed bar 120 and second pivot point 142 of fourth bar 134 pivotally connected to second pivot point 130 of movable second bar 126. Drive link 118 also has a first pivot point 144 and a second pivot point 146 that are spaced apart from one another. First pivot point 144 of drive link 118 is pivotally connected to movable fourth bar 134 and second pivot point 146 of drive link 118 is pivotally connected to hinge arrangement 106.

Since pivot points 122 and 124 are provided as portions of lower case 104, they are fixed in place relative to lower case 104. Since movable third bar 132 and movable fourth bar 134 are pivotally connected to these fixed pivot points 122 and 124 respectively, movement of movable third bar 132 and movable fourth bar 134 are limited to pivoting about these fixed pivot points. Additionally, since both movable third bar 132 and movable fourth bar 134 are also pivotally connected to pivot points 128 and 130 of movable second bar 126, third bar 132 and fourth bar 134 are forced to move in conjunction with one another. This common movement of third bar 132 and fourth bar 134 causes the movement of movable second bar 126, which is provided as portions of movable article mount 112.

As mentioned above, second pivot point 146 of drive link 118 is pivotally connected to hinge arrangement 106. As illustrated best by the sequence of FIGS. 2A-2D, in this embodiment, drive link 118 is pivotally connected to hinge arrangement 106 such that drive link 118 is pulled around the rotational axis of hinge arrangement 106 as upper case 102 is moved from the closed position to the open position. Similarly, drive link 118 is pushed back to its original position as upper case 102 is moved from the open position to the closed position. Since drive link 118 is also pivotally connected to movable fourth bar 134 at pivot point 144, movement of drive link 118 causes movement of movable fourth bar 134. This movement of fourth bar 134 causes simultaneous movement of both movable second bar 126 and movable third bar 132.

With the above described configuration, drive link 118 causes articulated linkage 110 to move article mount 112 from the stored position illustrated in FIG. 2A to the presentation position illustrated in FIG. 2D. This movement elevates article mount 112 relative to lower case 104 and presents any article that may be supported on article mount 112 when upper case 102 is moved from the closed position to the open position as illustrated by the sequence of FIGS. 2A through 2D. This configuration also causes drive link 118 to move article mount 112 back from the presentation position to the stored position when upper case 102 is moved from the open position to the closed position.

In the embodiment shown in FIGS. 1A-F and 2A-D, movable third bar 132 is provided as a wide decorative link having a desired aesthetic shape. First fixed pivot point 122 is provided as two spaced apart pivot points 122 that stabilize articulated linkage 110. In addition, first pivot 128 on movable article mount 112 is provided as two spaced apart pivot points 128 that stabilize article mount 112 as article mount 112 moves between the stored position and the presentation position.

Although the articulated linkage of presentation box 100 has been described as using a specific configuration of a four-bar linkage, this is not a requirement. Instead, the present invention would equally apply to a wide variety of other articulated linkage configurations. For example, the articulated linkage may include two narrow, but spaced apart four-bar linkages to stabilize the articulated linkage and article mount as the article mount moves between the stored position and the presentation position. Alternatively, the articulated linkage may include additional links to stabilize the motion of the linkage or to cause different or additional movements of elements of the linkage.

As illustrated best in FIGS. 2A-D, drive link 118 may be a pull link that is at least partially concealed in hinge arrangement 106 and four-bar linkage 116. Alternatively, the drive link may be fully concealed or fully visible depending upon the desired look of the presentation box. In the embodiment of presentation box 100 being described, and when viewed from the side as in FIGS. 2A-2D, drive link 118 has a wide V shape with one leg of the V being slightly curved and with pivot points 144 and 146 being at the open ends of the legs of the V. This shape allows clearance for drive link 118 relative to movable third bar 132 as articulated linkage 110 moves between the stored and presentation positions while keeping at least portions of drive link 118 concealed by movable third bar 132.

As shown best in FIG. 2A, movable third bar 132 may also include flanges 148 that may extend around both sides of drive link 118 and movable fourth bar 134. These flanges may be configured to conceal at least portions of drive link 118 and fourth bar 134 as articulated linkage 110 moves between the stored and the presentation positions. Movable fourth bar 134 may also have a curved decorative shape. Flanges 148 and movable fourth bar 134 may also be configured to align with article mount 112 when articulated linkage 110 is in the presentation position to provide a desired overall appearance. Flanges 148 may further include a foot 150 that seats on lower case 104 when articulated linkage 110 is in the stored position.

With the above described arrangement, the elements of articulated linkage 110 may be configured to align with one another such that they appear to be one decorative shape when the article mount is in the presentation position as illustrated in FIG. 1A. Article mount 112 may also be configured to support the article that is being stored and presented in presentation box 100 such that the article and the article mount and articulated linkage are all aligned with one another when the articulated linkage is in the presentation position as illustrated best in FIG. 2D.

As described above, the sequence of FIGS. 2A through 2D illustrates a preferred embodiment of finger ring presentation box 100 showing clearance for the ring and the articulated linkage when the box is fully closed and throughout its range of motion. These figures show how the ring remains in the slightly forward leaning orientation from the closed position and throughout its range of motion, including the fully open position. These figures also show clearance between the outer portions of the ring and the edge of the upper case as the upper case moves between the open and closed positions.

Varying the lengths and exact positions of the pivot points of the various elements making up the articulated linkage of the present invention allow for a wide variety of possible movements and positions for the article mount. Part of the uniqueness of the mechanism involves configuring the linkage to provide a desired starting and stopping point of the article mount movement with respect to the closed and open positions of the upper case. In preferred embodiments, this may be done in a visually appealing manner while insuring that the linkage does not cause any clearance issues for the article being presented throughout its range of motion of the linkage. With this in mind, it should be understood that relatively minor alterations of the linkage configuration may have significant impacts on the motion of the linkage.

For example, for the configuration described above, increasing the length of movable third bar 132 may create an interference issue between the ring and the edge of the upper case as the presentation box is opened. This may also cause the article mount to tilt forward out of alignment with the articulated linkage when the linkage is in the presentation position.

In another example, increasing the length of movable fourth bar 134 may cause the ring to sit in a more vertical orientation than desired which may limit clearance when the presentation box is fully closed. The ring may also tilt out of alignment with the articulated linkage with the ring being more upright than the preferred embodiment.

Increasing the length of both movable third bar 132 and movable fourth bar 134 in a proportionately similar manner causes the mechanism to move in a manner similar to the embodiment described, but with a path of motion that is at a greater distance from the fixed bar 120. This increase may result in clearance issues between the articulated linkage and the front end of the case, but it still allows the alignment of the ring, ring mount, and linkage when the upper case is in its fully opened position. Increasing the length of both third and fourth bars 132 and 134 in this way would be a viable option if the length of the upper and lower cases increases in a proportionately similar manner.

Increasing or decreasing the length of movable second bar 126 varies the amount that the article mount rotates relative to its starting position as the mechanism moves through its range of motion. This feature may be used to control the orientation of the article such that it may have desired orientations in both the stored position and the presentation position.

Changing the length of drive link 118 and the location of the pivot point at which the drive link attaches to the linkage changes the range of motion of the linkage. This may be used to control the starting and stopping points that correspond to the stored and presentation positions. This may also be used to control the orientation of the upper case relative to the lower case when the presentation box is in the fully open position.

It should be understood that there are innumerable combinations of pivot point placements and bar lengths for the proposed articulated linkage and the drive link that connects the linkage to the presentation box. Many of these possible configurations may produce desirable results and it should be understood that any of these combinations fall within the scope of the present invention.

Although the above described embodiment includes a drive link, it should be understood that other mechanisms may be used to actuate the articulated linkage. For example, a rocker arm may push a lever connected to the linkage, causing the mechanism to function in a manner similar to the embodiment previously described. In addition, although drive link 118 has been described as being pivotally connected to fourth bar 134, this is not a requirement. Instead, the drive link or other mechanism for actuating the articulated linkage may be connected to any one of the movable elements of the articulated linkage and remain within the scope of the invention.

Although the articulated linkage has been described as a four-bar linkage, it should be understood that this is not a requirement. Instead, the articulated linkage may include other numbers of links so long as there are a plurality of links making up the articulated linkage. For example, more than four bars could be used in the linkage to create a more complex mechanism to achieve a similar motion, or to provide additional features as will be described hereinafter.

The various elements of presentation box 100 may be made from any suitable and readily providable material. In one embodiment, upper case 102 and lower case 104 may be made from jewelry quality silver to provide a high quality appearance and articulated linkage 110 and article mount 112 may be made from stainless steel to provide high tolerances and durability.

Figure 3:
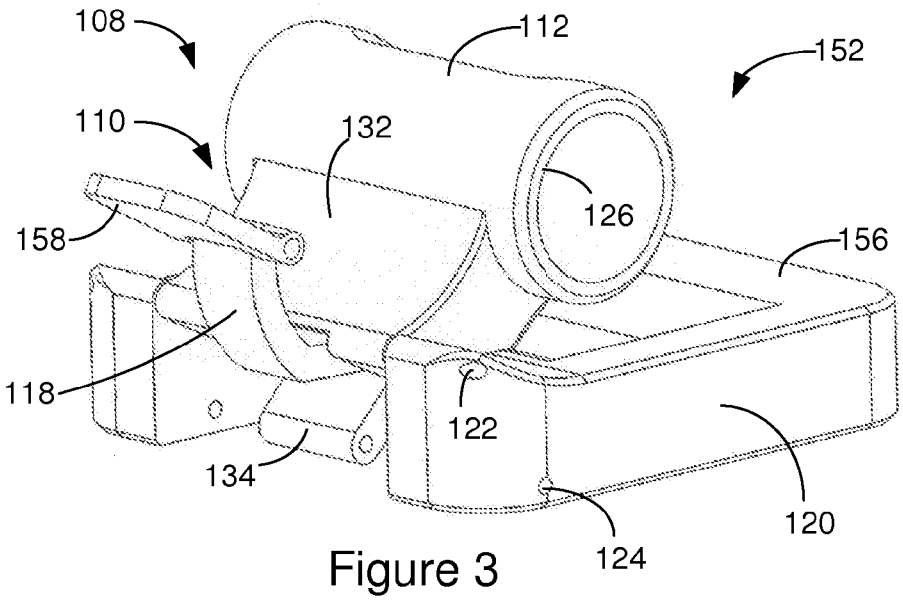
FIG. 3 is a perspective illustration of an articulated linkage for use in a gift presentation box in accordance with aspects of the present invention.
Figure 4:
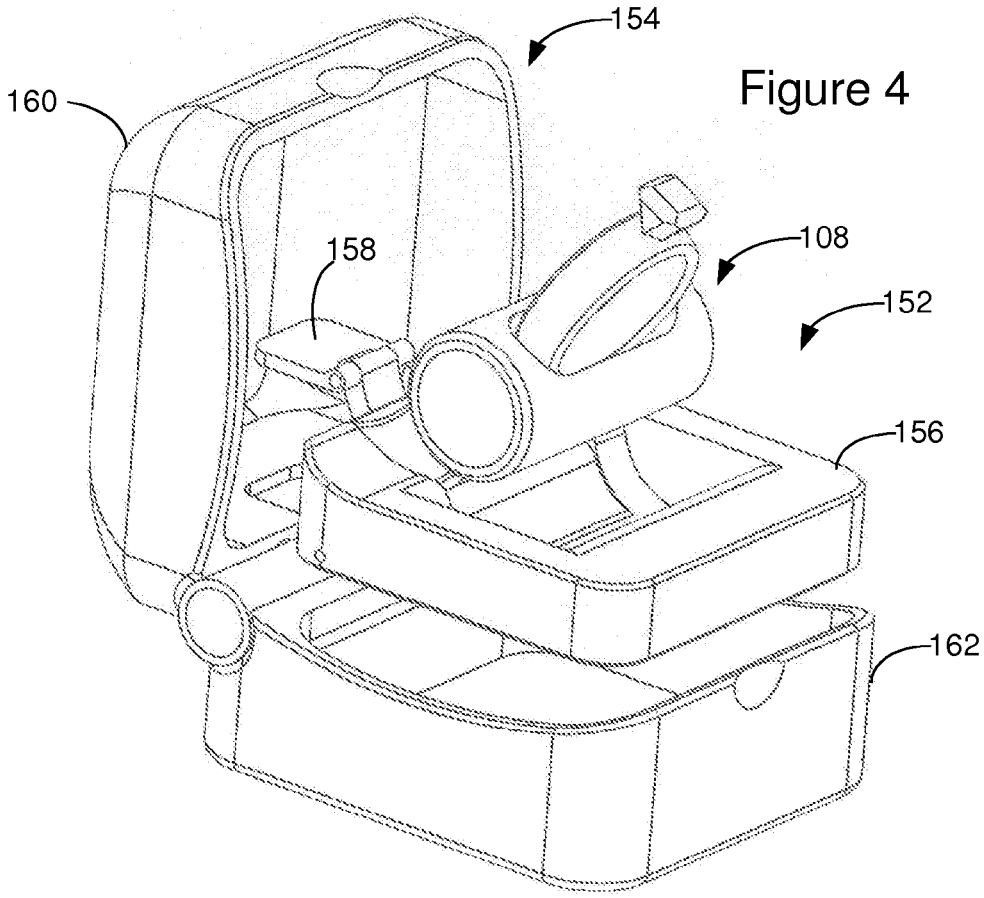
FIG. 4 is a perspective illustration of the articulated linkage of FIG. 3 being installed in a gift presentation box in accordance with aspects of the present invention.

Although the presentation box of the present invention has up to this point been described as having the articulated linkage constructed as part of the overall presentation box, this is not a requirement. Instead, it should be understood that at least portions of the articulated linkage may be provided as a separate, removable linkage assembly. In accordance with aspects of the invention and as illustrated in FIGS. 3 and 4, a removable linkage assembly 152 may be used to provide a separate self-contained linkage sub-assembly. As illustrated best in FIG. 4, removable linkage assembly 152 may be attached to a more conventional gift box such as a suitable and readily providable gift box 154 to provide an overall presentation box with a presentation arrangement 108 in accordance with aspects of the invention.

In the embodiment shown in FIGS. 3 and 4, removable linkage assembly 152 may include articulated linkage 110 and movable article mount 112 as described above for presentation box 100. However, in this embodiment, removable linkage assembly 152 may further include a base 156 and a drive link tab 158 for attaching removable linkage assembly 152 to a suitable and readily providable gift box such as gift box 154. Base 156 and drive link tab 158 may act as retaining pieces for retaining removable linkage assembly 152 within the gift box. These retaining pieces also allow removable linkage assembly 152 to be disconnected from the gift box.

Any suitable and readily providable arrangement may be used to attach removable linkage assembly to a gift box. This includes, but is not limited to fasteners, adhesives, flanges, snap-in gripping arrangements, etc. As illustrated in FIGS. 3 and 4, drive link tab 158 may be attached to an upper case 160 of gift box 154 and base 156 may be attached to or configured to nest within a lower case 162 of gift box 154. In this embodiment, drive link 118 of articulated linkage 110 is pivotally connected to drive link tab 158 rather than the hinge arrangement of the gift box as was described above for presentation box 100. With this configuration, the movement of upper case 160 of gift box 154 causes drive link tab 158 to move drive link 118. Drive link 118 in turn moves articulated linkage 110 in a manner similar to that described above for presentation box 100.

FIGS. 5A-5D illustrate another embodiment of a presentation box 200 in accordance with aspects of the invention. Presentation box 200 includes upper case 102, a lower case 104, hinge arrangement 106, articulated linkage 110, movable article mount 112, four-bar linkage 116, and drive link 118 similar to those described above for presentation box 100. Four-bar linkage 116 includes fourth-bar 134 that is pivotally connected to drive link 118 at pivot point 144. However, in this embodiment, articulated linkage 110 further includes a delaying arrangement 202 that delays the time at which the article mount begins to move from the stored position to the presentation position relative to the upper case being moved from the closed position to the open position.

Figure 5A:
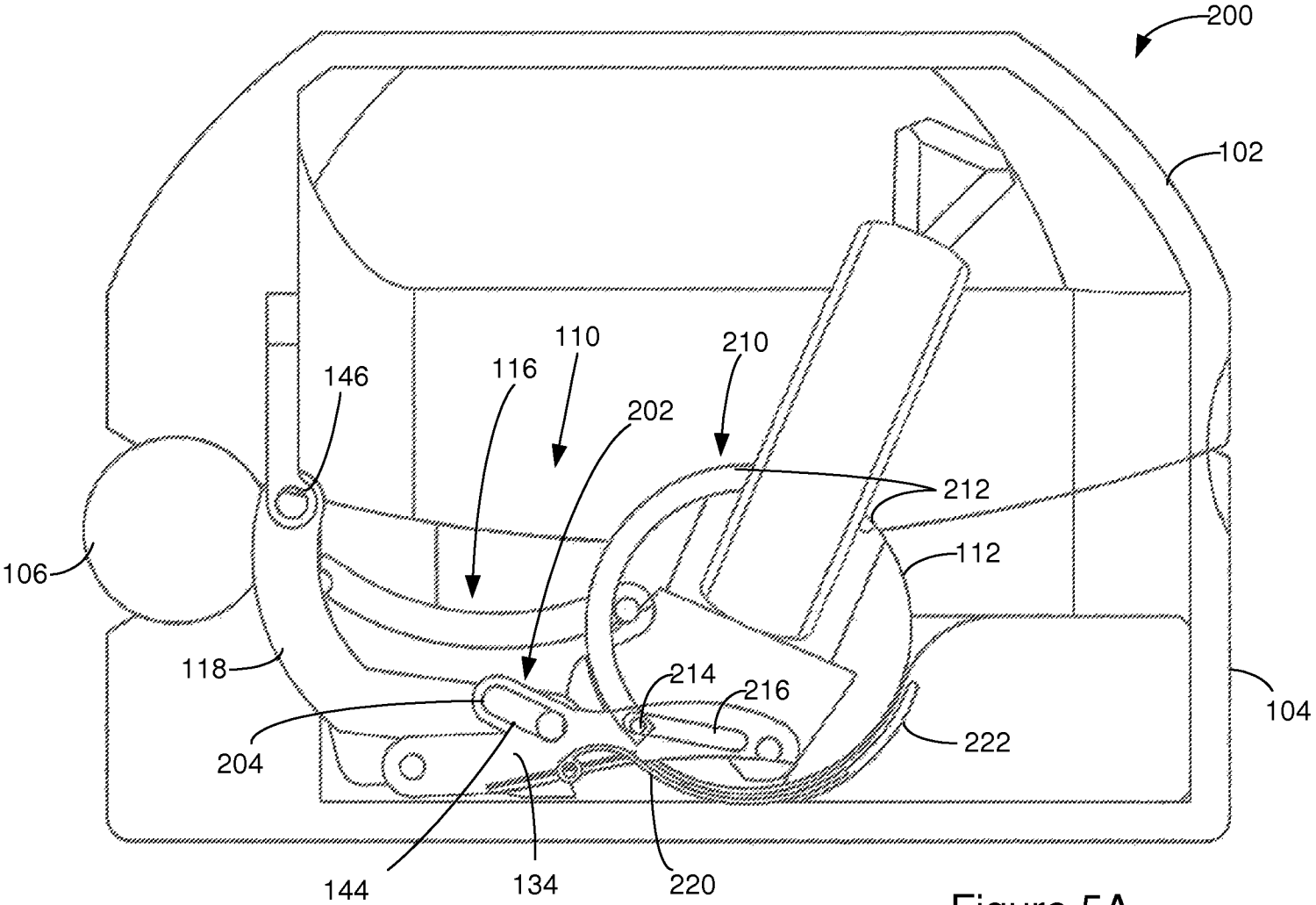
FIG. 5A is a side view of another embodiment of a gift presentation box in accordance with aspects of the present invention in the closed position showing the internal elements of the presentation box.
Figure 5B:
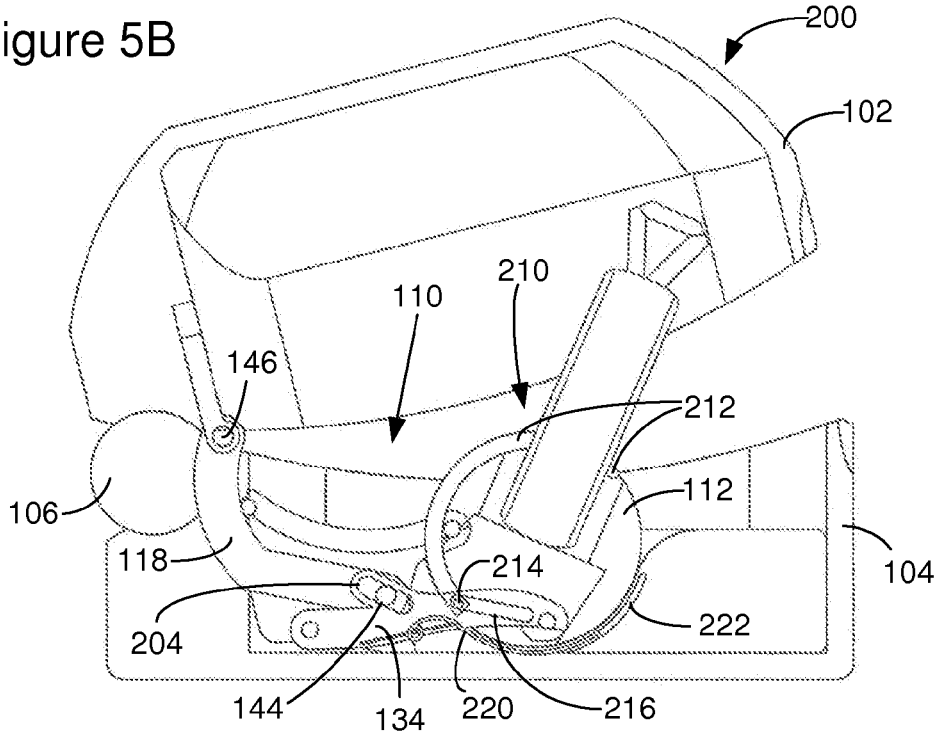
FIGS. 5B and 5C are side views of the gift presentation box of FIG. 5A in progressive stages of being moved from the closed position to the open position showing the internal elements of the presentation box.
Figure 5C:
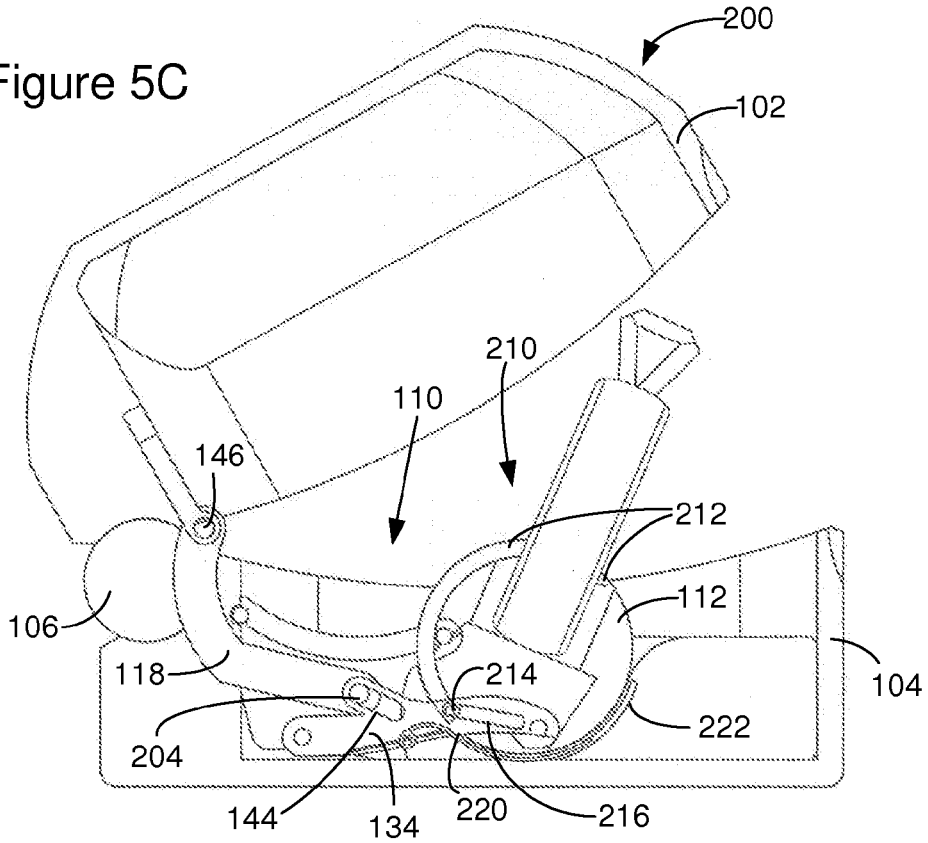
Figure 5D:
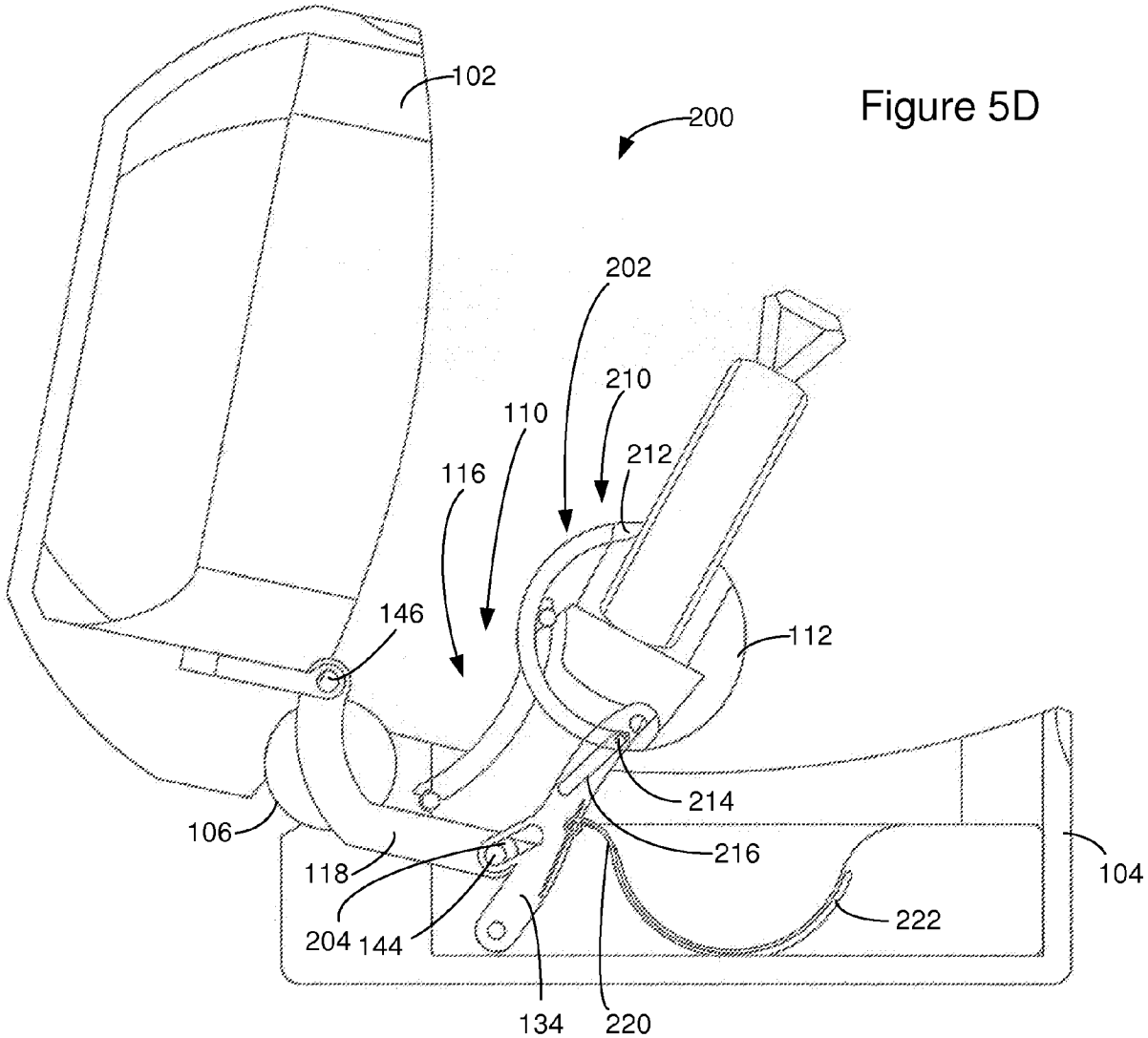
FIG. 5D is a side view of the gift presentation box of FIG. 5A in the open position showing the internal elements of the presentation box.

In the specific embodiment illustrated in FIGS. 5A through 5D, delaying arrangement 202 is provided by pivot point 144 including a drive link slide or slot 204 formed into movable fourth bar 134 of four-bar linkage 116. Drive link slide 204 is still used as the pivot point between drive link 118 and fourth bar 134. However, since pivot point 144 includes drive link slide 204 in fourth bar 134, drive link 118 is allowed to slide within drive link slide 204 for some distance before causing the movement of four-bar linkage 116 as illustrated in the sequence of FIGS. 5A through 5C. This delays the movement of four-bar linkage 116 relative to the upper case being moved from the closed position to the open position. Once drive link 118 engages the end of drive link slide 204 as illustrated in FIG. 5C, drive link 118 causes the movement of articulated linkage 110 from the stored position to the presentation position as illustrated by the sequence of FIGS. 5C to 5D.

Although drive link slide 204 has been described as being formed into movable fourth bar 134, it should be understood that similar results may be provided by forming a slot or drive link slide into drive link 118 at pivot point 144. Alternatively, the slot or drive link slide may be located in either the drive link or the other elements of the presentation box at pivot point 146 at the other end of drive link 118.

In accordance with another aspect of the invention, articulated linkage 110 may include a securing arrangement 210. Securing arrangement 210 may be driven by the movement of articulated linkage 110 such that securing arrangement 210 secures the article in place on article mount 112 when upper case 102 is in the closed position and releases the article so that the article may be removed from article mount 112 when upper case 102 is in the open position.

In the specific embodiment illustrated in FIGS. 5A through 5D in which the article being presented is a finger ring, securing arrangement 210 is provided by a movable retaining piece 212. Movable retaining piece 212 makes up a portion of article mount 112 and it is configured to be movable around the outer perimeter of article mount 112. As illustrated best in FIG. 5A, movable retaining piece 212 is also configured to extend through the opening of the finger ring when presentation box 200 is in the closed position. Movable retaining piece 212 may include a drive point 214 that is driven by a drive slot 216 formed into fourth bar 134. With this arrangement, drive slot 216 may be configured to drive drive point 214 and move movable retaining piece 212 around the perimeter of article mount 112 as fourth bar 134 and articulating linkage 110 are moved from the stored position to the presentation position as illustrated best in the sequence of FIGS. 5C and 5D.

In accordance with another aspect of the invention, articulated linkage 110 may include a movable cover 220 that moves with the articulated linkage to concealing elements of the articulated linkage as the articulated linkage moves from the stored position to the presentation position. In the specific embodiment illustrated in FIGS. 5A through 5D, movable cover 220 is provided by a resilient but flexible material that slides within a slide cover track 222. Movable cover 220 may include a drive point or points that may be driven by a drive slot formed into fourth bar 134 in a manner similar to that described above for movable retaining piece 212. With this arrangement, movable cover 220 may be configured to move with the movement of articulated linkage 110 to cover portions of articulated linkage 110 and presentation box 200 when articulated linkage 110 is moved from the storage position to the presentation position as illustrated in FIGS. 5C and 5D.

Figure 6:
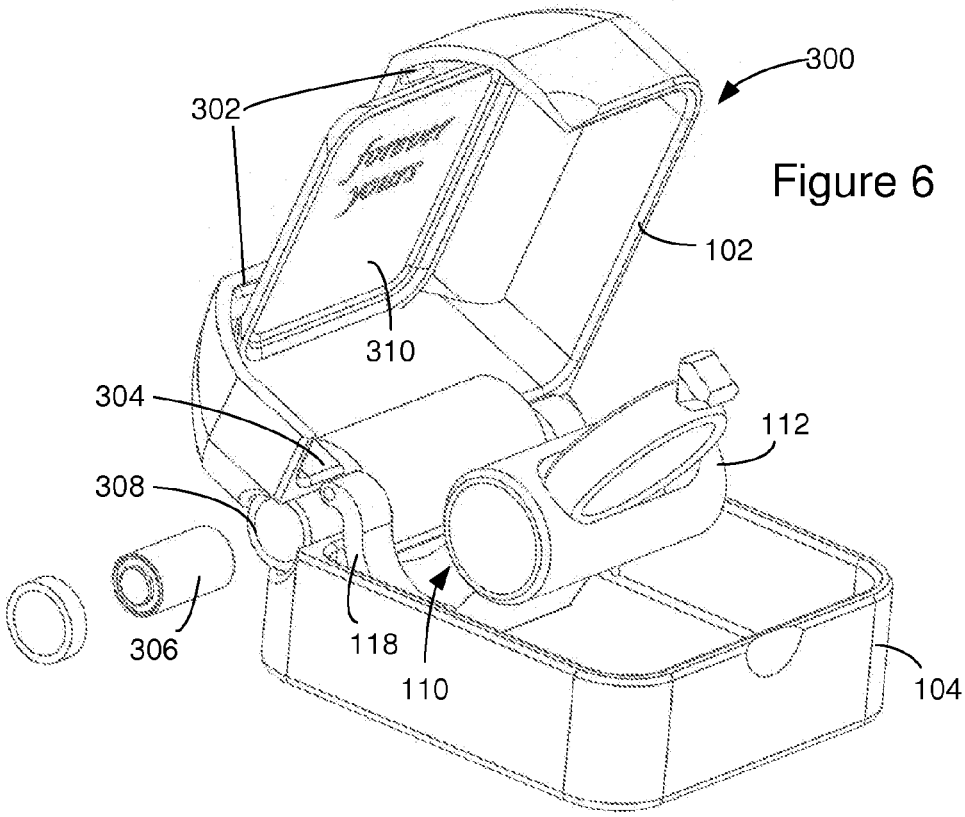
FIG. 6 is a partially cut away perspective illustration of another embodiment of a gift presentation box in accordance with aspects of the present invention in the open position.

Referring now to FIG. 6, a number of additional features that may be included in a presentation box 300 in accordance with aspects of the invention will be described. Presentation box 300 includes upper case 102, lower case 104, articulated linkage 110, article mount 112, and drive link 118 similar to those described above for presentation box 100. Presentation box 300 may further include a light source 302, a switch 304, and a battery 306. In the embodiment shown, presentation box 300 includes an oversized hinge arrangement 308 that houses battery 306. Hinge arrangement 308 may also include switch 304 for activating light source 302 when the upper case is in the open position. Presentation box 300 may further include a custom engraved plate 310. Engraved plate 310 may be engraved all the way through the thickness of the plate such that light from light source 302 may pass through the engraving. Engraved plate 310 may be positioned within presentation box 300 to direct light around the plate to provide indirect lighting for lighting the article being presented in presentation box 300. Presentation box 300 may further include a motor or other actuator for causing the articulated linkage to move rather than using the movement of the upper case to cause the articulated linkage to move.

Although presentation boxes 100, 200 and 300 have been shown as finger ring boxes, this is not a requirement. Instead, the presentation box of the present invention may be used for presenting a wide variety of articles. FIGS. 7A-7D and FIG. 8 illustrate another embodiment of a presentation box 400 in accordance with aspects of the invention.

Figure 8:
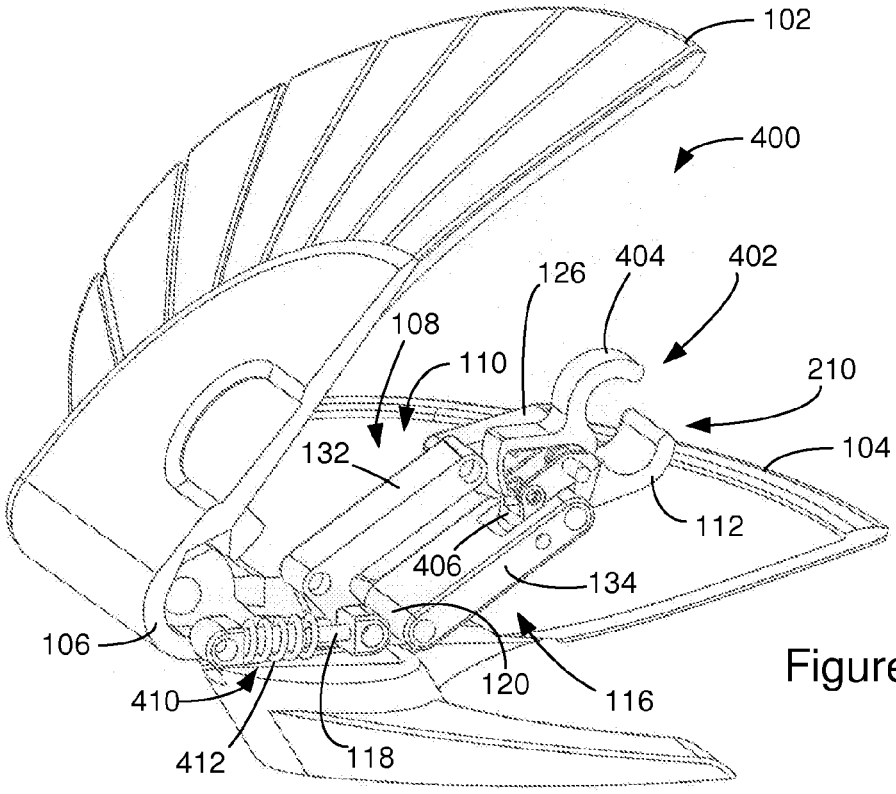
FIG. 8 is a partially cut away perspective view of the presentation box of FIG. 7A with the presentation box in the open position.
Figure 7C:
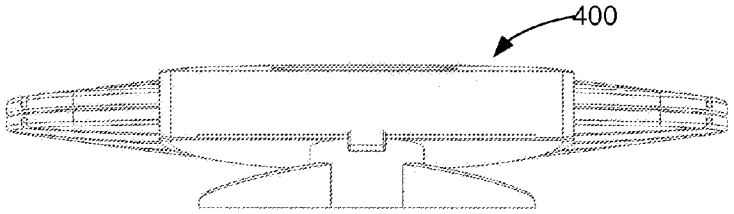
FIG. 7C is a back view of the gift presentation box of FIG. 7A in the closed position.
Figure 7B:
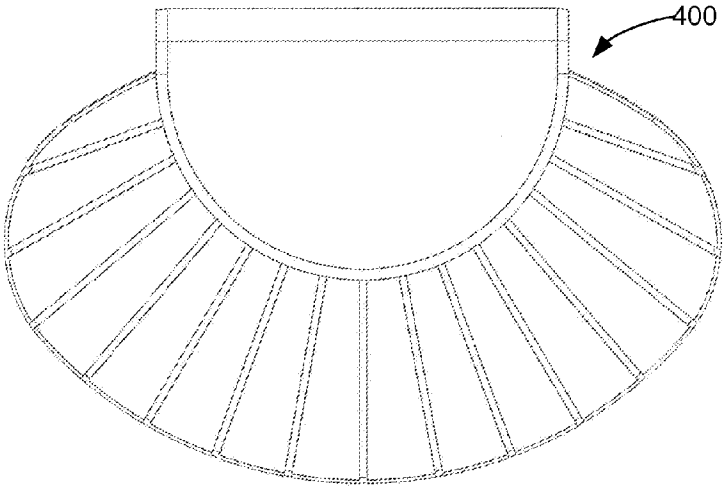
FIG. 7B is a top view of the gift presentation box of FIG. 7A in the closed position.
Figure 7A:
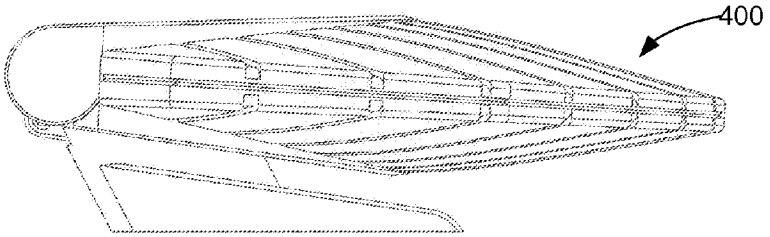
FIG. 7A is a side view of another embodiment of a gift presentation box in accordance with aspects of the present invention in the closed position
Figure 7D:
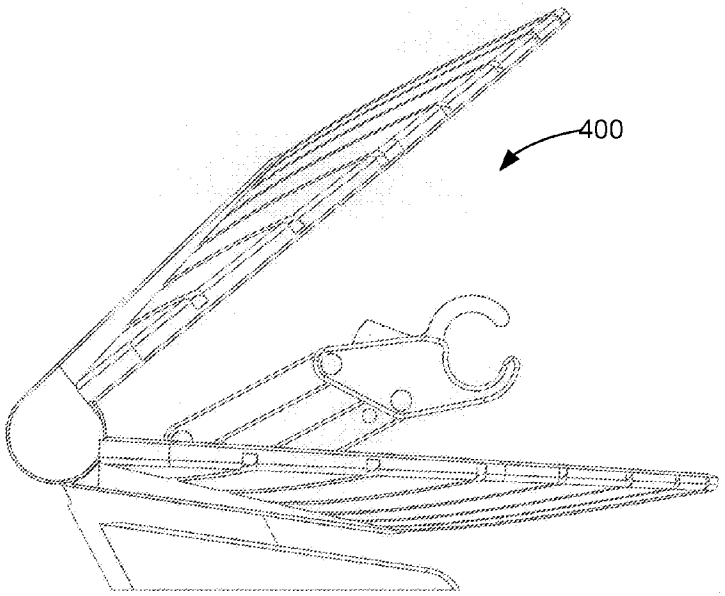
FIG. 7D is a side view of the gift presentation box of FIG. 7A in the open position.

In the specific embodiment shown in FIGS. 7A-7D and FIG. 8, presentation box 400 takes the form of a pen presentation box having a clam shell shape for storing and presenting a pen. Although this embodiment has a very different aesthetic appearance, the components making up presentation box 400 are similar to those described above for presentation box 100. As illustrated best in FIG. 8, presentation box 400 includes upper case 102, lower case 104, hinge arrangement 106, presentation arrangement 108, articulated linkage 110, article mount 112, four-bar linkage 116, and drive link 118. As was described above, four-bar linkage 116 includes a fixed bar 120 that is provided by portions of lower case 104, a movable second bar 126 that is provided as part of article mount 112, a movable third bar 132, and a movable fourth bar 134. In this embodiment, movable third bar 132 has an L shape with a lever arm extending down toward fourth bar 134 and drive link 118 is pivotally connected between hinge arrangement 106 and the lower end of the lever arm leg of third bar 132. Although this specific configuration is somewhat different than the configuration described for presentation box 100, the function and motion of the articulated linkage is similar.

Articulated linkage 110 of presentation box 400 also includes a securing arrangement 210 similar to that described for presentation box 200. However, in this embodiment, securing arrangement 210 includes a gripping arrangement 402. As illustrated in FIG. 8, gripping arrangement 402 includes a biased gripping element 404 that is driven by a drive link 406 that is driven by fourth bar 134. Biased gripping element 404 may include a clothes pin type spring for biasing the gripping element to grip the pen (not shown) while allowing the gripping arrangement to accommodate a variety of pen sizes. With this arrangement, biased gripping element 404 is configured to grip the pen on article mount 112 when articulated linkage 110 is in the stored position and release the pen as fourth bar 134 and articulating linkage 110 are moved to the presentation position as illustrated in FIG. 8.

As illustrated in FIG. 8, the articulated linkage may include a dampening arrangement 410 that controls the speed at which the article mount moves from the stored position to the presentation position. This dampening arrangement allows the movement of the article mount from the stored position to the presentation position to take longer than the time in which the upper case is moved from the closed position to the open position.

In the specific embodiment shown in FIG. 8, dampening arrangement 410 is provided by a spring 412 making up at least a portion of drive link 118. Drive link 118 may also include a dampening element such as a small shock absorber. Alternatively, the pivot points making up articulated linkage 110 may be designed with a desired resistance or friction to provide the dampening effect.

A number of implementations of the present disclosure have been described. Nevertheless, it should be understood that various modifications may be made without departing from the spirit and scope of the present disclosure. For example, although the implementations described above have described the presentation box as being a finger ring presentation box or a pen presentation box, this is not a requirement. Accordingly, other implementations are within the scope of the following claims.

| Listing of Reference Numerals | |
|---|---|
| 100 | Gift Presentation Box |
| 102 | Upper Case |
| 104 | Lower Case |
| 106 | Hinge Arrangement |
| 108 | Presentation Arrangement |
| 110 | Articulated Linkage |
| 112 | Movable Article Mount |
| 114 | Curved Parting Line |
| 116 | Four-Bar Linkage |
| 118 | Drive Link |
| 120 | Fixed Bar |
| 122 | First Pivot Point Fixed Bar |
| 124 | Second Pivot Point Fixed Bar |
| 126 | Movable Second Bar |
| 128 | First Pivot Point Second Bar |
| 130 | Second Pivot Point Second Bar |
| 132 | Third Bar |
| 134 | Fourth Bar |
| 136 | First Pivot Point Third Bar |
| 138 | Second Pivot Point Third Bar |
| 140 | First Pivot Point Fourth Bar |
| 142 | Second Pivot Point Fourth Bar |
| 144 | First Pivot Point Drive Link |
| 146 | Second Pivot Point Drive Link |
| 148 | Flanges |
| 150 | Foot |
| 152 | Removable Linkage Assembly |
| 154 | Gift Box |
| 156 | Base |
| 158 | Drive Link Tab |
| 160 | Upper Case |
| 162 | Lower Case |
| 200 | Presentation Box |
| 202 | Delaying Arrangement |
| 204 | Drive Link Slide |
| 210 | Securing Arrangement |
| 212 | Movable Retaining Piece |
| 214 | Drive Point |
| 216 | Drive Slot |
| 220 | Movable Cover |
| 222 | Side Cover Track |
| 300 | Presentation Box |
| 302 | Light Source |
| 304 | Switch |
| 306 | Battery |
| 308 | Oversized Hinge Arrangement |
| 310 | Engraved Plate |
| 400 | Presentation Box |
| 402 | Gripping Arrangement |
| 404 | Biased Gripping Element |
| 406 | Drive Link |
| 410 | Dampening Arrangement |
| 412 | Spring |

What is claimed is:

1. A presentation box for storing and presenting an article, the presentation box comprising:

an upper case forming a top portion of the presentation box;

a lower case forming a bottom portion of the presentation box;

a hinge arrangement for connecting the upper case to the lower case such that the upper case may be pivoted relative to the lower case between a closed position in which the upper case and the lower case define an enclosed volume for storing the article within the presentation box and an open position for presenting the article;

a movable article mount for supporting the article to be presented in the presentation box; and an articulated linkage including a plurality of links connecting the article mount to other elements of the presentation box such that the articulated linkage moves the article mount from a stored position when the upper case is in the closed position to a presentation position that is elevated relative to the stored position when the upper case is in the open position thereby presenting the article when the upper case is moved from the closed position to the open position, the articulated linkage including a four-bar linkage and a drive link with portions of the lower case acting as a fixed bar of the four-bar linkage with the fixed bar having a first and a second spaced apart pivot point, the movable article mount acting as a movable second bar of the four-bar linkage with the movable second bar having a first and a second spaced apart pivot point, the four-bar linkage further including a movable third bar and a movable fourth bar with both the third bar and the fourth bar having a first and a second spaced apart pivot point, the movable third bar being pivotally connected between the fixed bar and the movable second bar with the first pivot point of the third bar pivotally connected to the first pivot point of the fixed bar and the second pivot point of the third bar pivotally connected to the first pivot point of the movable second bar, the movable fourth bar being pivotally connected between the fixed bar and the movable second bar with the first pivot point of the fourth bar pivotally connected to the second pivot point of the fixed bar and the second pivot point of the fourth bar pivotally connected to the second pivot point of the movable second bar, and the drive link having a first and a second spaced apart pivot point with the first pivot point being pivotally connected to one of the movable bars and the second pivot point being pivotally connected to other elements of the presentation box such that the drive link causes the four-bar linkage to elevate the movable article mount relative to the lower case and present the article when the upper case is moved from the closed position to the open position.

2. A presentation box according to claim 1 wherein the article mount and the articulated linkage maintain the article in a generally upright orientation throughout the range of motion of the article mount from the stored position to the presentation position.

3. A presentation box according to claim 1 wherein the articulated linkage includes a dampening arrangement that controls the speed at which the article mount moves from the stored position to the presentation position thereby allowing the movement of the article mount from the stored position to the presentation position to take longer than the time in which the upper case is moved from the closed position to the open position.

4. A presentation box according to claim 1 wherein the articulated linkage includes a delaying arrangement that delays the time at which the article mount begins to move from the stored position to the presentation position relative to the upper case being moved from the closed position to the open position.

5. A presentation box according to claim 1 wherein the articulated linkage is a separate self-contained sub-assembly that may be attached to other elements of the presentation box.

6. A presentation box according to claim 5 wherein the articulated linkage includes a retaining piece for retaining the linkage within the presentation box and wherein there is access to the retaining piece that allows at least portions of the articulated linkage to be disconnected from the other elements of the presentation box.

7. A presentation box according to claim 1 wherein the movable third bar is a wide link with the first and second pivot points each including two spaced apart pivot points to stabilize the articulated linkage and article mount as the article mount moves from the stored position to the presentation position.

8. A presentation box according to claim 1 wherein the drive link is a pull link that is concealed in the hinge arrangement and the four-bar linkage.

9. A presentation box according to claim 1 wherein the elements of the articulated linkage align such that they appear to be one decorative shape when the article mount is in the presentation position.

10. A presentation box according to claim 1 wherein the articulated linkage includes a securing arrangement that is driven by the movement of the articulated linkage such that the securing arrangement secures the article in place on the article mount when the upper case is in the closed position and releases the article so that the article may be removed from the article mount when the upper case is in the open position.

11. A presentation box according to claim 1 wherein the articulated linkage includes a movable cover that moves with the articulated linkage to conceal elements of the articulated linkage as the article mount moves from the stored position to the presentation position.

12. An articulated linkage for use in a presentation box for storing and presenting an article, the presentation box including an upper case forming a top portion of the presentation box and a lower case forming a bottom portion of the presentation box, the presentation box further including a hinge arrangement for connecting the upper case to the lower case such that the upper case may be pivoted relative to the lower case between a closed position in which the upper case and the lower case define an enclosed volume for storing the article within the presentation box and an open position for presenting the article, the articulated linkage comprising;

a movable article mount for supporting the article to be presented in the presentation box; and a plurality of links connecting the article mount to elements of the presentation box when the articulated linkage is installed in the presentation box such that the articulated linkage moves the article mount from a stored position to a presentation position that is elevated relative to the stored position when the articulated linkage is installed in the presentation box and when the upper case of the presentation box is moved from the closed position to the open position, the plurality of links including at least portions of a four-bar linkage and a drive link with the four-bar linkage including a fixed bar with the fixed bar having a first and a second spaced apart pivot point, the movable article mount acting as a movable second bar of the four-bar linkage with the movable second bar having a first and a second spaced apart pivot point, the four-bar linkage further including a movable third bar and a movable fourth bar with both the third bar and the fourth bar having a first and a second spaced apart pivot point, the movable third bar being pivotally connected between the fixed bar and the movable second bar with the first pivot point of the third bar pivotally connected to the first pivot point of the fixed bar and the second pivot point of the third bar pivotally connected to the first pivot point of the movable second bar, the movable fourth bar being pivotally connected between the fixed bar and the movable second bar with the first pivot point of the fourth bar pivotally connected to the second pivot point of the fixed bar and the second pivot point of the fourth bar pivotally connected to the second pivot point of the movable second bar, and the drive link having a first and a second spaced apart pivot point with the first pivot point being pivotally connected to one of the movable bars and the second pivot point being pivotally connected to elements of the presentation box when the articulated linkage is installed in the presentation box such that the drive link causes the four-bar linkage to move the movable article mount from the stored position to the presentation position and present the article as the upper case of the presentation box is moved from the closed position to the open position.

13. An articulated linkage according to claim 12 wherein the articulated linkage includes a retaining piece for retaining the linkage within the presentation box and wherein there is access to the retaining piece that allows at least portions of the articulated linkage to be disconnected from the elements of the presentation box.

14. An articulated linkage according to claim 12 wherein the fixed bar of the four-bar linkage is provided as part of the lower case and the movable third bar is a wide link with the first and second pivot points each including two spaced apart pivot points to stabilize the articulated linkage and article mount as the article mount moves from the stored position to the presentation position.

15. An articulated linkage according to claim 12 wherein the elements of the articulated linkage align such that they appear to be one decorative shape when the article mount is in the presentation position.

16. An articulated linkage according to claim 12 wherein the articulated linkage includes a securing arrangement that is driven by the movement of the articulated linkage such that the securing arrangement secures the article in place on the article mount when the article mount is in the stored position and releases the article so that the article may be removed from the article mount when the article mount is in the presentation position.

17. An articulated linkage according to claim 12 wherein the articulated linkage includes a movable cover that moves with the articulated linkage to conceal elements of the articulated linkage as the article mount moves from the stored position to the presentation position.

* * * * *